US006916108B2

(12) United States Patent
Swanson

(10) Patent No.: US 6,916,108 B2
(45) Date of Patent: Jul. 12, 2005

(54) LAMP HAVING LOW LIGHT LEVEL REPLACEABLE BULB

(75) Inventor: Dennis K. Swanson, Woodland Hills, CA (US)

(73) Assignee: Lamps Plus, Inc., Chatsworth, CA (US)

( * ) Notice: Subject to any disclaimer, the term of this patent is extended or adjusted under 35 U.S.C. 154(b) by 31 days.

(21) Appl. No.: 10/449,498

(22) Filed: May 30, 2003

(65) Prior Publication Data

US 2004/0240212 A1 Dec. 2, 2004

(51) Int. Cl.[7] ..... F21S 8/08

(52) U.S. Cl. ..... 362/410; 362/363; 362/375; 362/412; 362/414

(58) Field of Search ..... 362/410, 412, 362/414, 413, 375, 363

(56) References Cited

U.S. PATENT DOCUMENTS

| | | | | | |
|---|---|---|---|---|---|
| 1,863,607 | A | * | 6/1932 | Sabath | 362/412 |
| 2,202,357 | A | * | 5/1940 | Soriano | 242/396.1 |
| 2,945,948 | A | * | 7/1960 | Maffei | 362/228 |
| 3,025,392 | A | * | 3/1962 | Worth | 362/362 |
| 5,019,753 | A | * | 5/1991 | Strauss | 315/362 |
| 5,067,060 | A | * | 11/1991 | Sieracki | 362/101 |
| 5,121,313 | A | * | 6/1992 | Chang | 362/412 |
| 5,642,930 | A | * | 7/1997 | Brown, Sr. | 362/124 |
| 5,782,554 | A | * | 7/1998 | Huang | 362/294 |
| 5,806,973 | A | * | 9/1998 | Porter | 362/412 |
| 6,135,622 | A | * | 10/2000 | Downing | 362/410 |
| 6,616,298 | B1 | * | 9/2003 | Bernhard | 362/226 |
| 2003/0007360 | A1 | * | 1/2003 | Hsieh | 362/411 |
| 2004/0095781 | A1 | * | 5/2004 | Lo | 362/555 |

* cited by examiner

*Primary Examiner*—Sandra O'Shea
*Assistant Examiner*—Jacob Y. Choi
(74) *Attorney, Agent, or Firm*—Fulbright & Jaworski L.L.P.

(57) ABSTRACT

A lamp having at least a portion of a body formed of translucent material defining a hollow chamber within which a low light level light bulb is housed. A portion of the body is removable to provide easy access to the light bulb for removal and changing when required.

13 Claims, 5 Drawing Sheets

LAMP HAVING LOW LIGHT LEVEL REPLACEABLE BULB

FIELD OF THE INVENTION

This invention relates generally to lamps and more particularly to a lamp which includes a general-area lighting means and, in addition, includes a low light level lighting means and is directed specifically to a structure permitting easy replacement of the low light level light bulb.

BACKGROUND OF THE INVENTION

Floor lamps, desk lamps and table lamps are all very well known in the lighting industry. Many of such lamps contain multi-position switches for changing the level of illumination provided by the general area lighting means incorporated within such lamps. Low light level lamps, commonly referred to as night lights, are also well known in the lighting industry and are constructed having many different configurations. It is also known in the prior art to incorporate a low light level light bulb into a table lamp, floor lamp or desk lamp. In many instances, the incorporation of the low light level light bulb accomplishes the additional function of providing a more decorative appearance to the body of the lamp. The present invention is specifically directed to a lamp, which can be a desk lamp, table lamp or floor lamp, of the type which also incorporates as an integral part thereof a low light level bulb housed within the body of the lamp to provide decoration as well as a night light function. In such prior art structures, it is extremely difficult to replace the low light level light bulb when it has burned out. Prior art lamps of this type generally require extensive dismantling of the lamp to gain access to the interior of the lamp to replace the low light level light bulb. In one such prior art lamp the base had to be removed to replace the bulb.

Therefore, there is need in the lighting industry for a lamp which incorporates both a general area lighting means and a low light level light bulb (night light) which also provides a means for ready access to the low light level light bulb so that it may be easily changed when such is required.

SUMMARY OF THE INVENTION

A lamp having a low light level bulb housed within a hollow chamber which includes an enclosure defining the hollow chamber and means for supporting the bulb within the chamber. At least a portion of the enclosure is formed of translucent material and the lamp includes means in the enclosure for providing access to the low light level bulb to change the bulb.

DETAILED DESCRIPTION

A lamp constructed in accordance with the principles of the present invention provides general area lighting and at the same time includes a low light level illumination bulb such as a night light which is contained within the body of the lamp and when illuminated provides both a decorative feature for the lamp and a night light function. This is accomplished by having the body of the lamp constructed from translucent material or alternatively having portions thereof constructed of translucent material. A multi-way switch 22 is incorporated as a part of the lamp's structure so that the general area lamp or the night light or both may be energized as desired. The low illumination level light bulb is easily replaceable by removing a locking ring and lifting a portion of the body to gain access to the bulb which may then be replaced and reinserted into the lamp after which the top and the locking ring are reassembled. The night light portion of the lamp in accordance with the present invention may be utilized on any type of lamp structure such for example as a desk lamp, a table lamp or a floor lamp without departing from the spirit or scope of the present invention.

Figure 1:
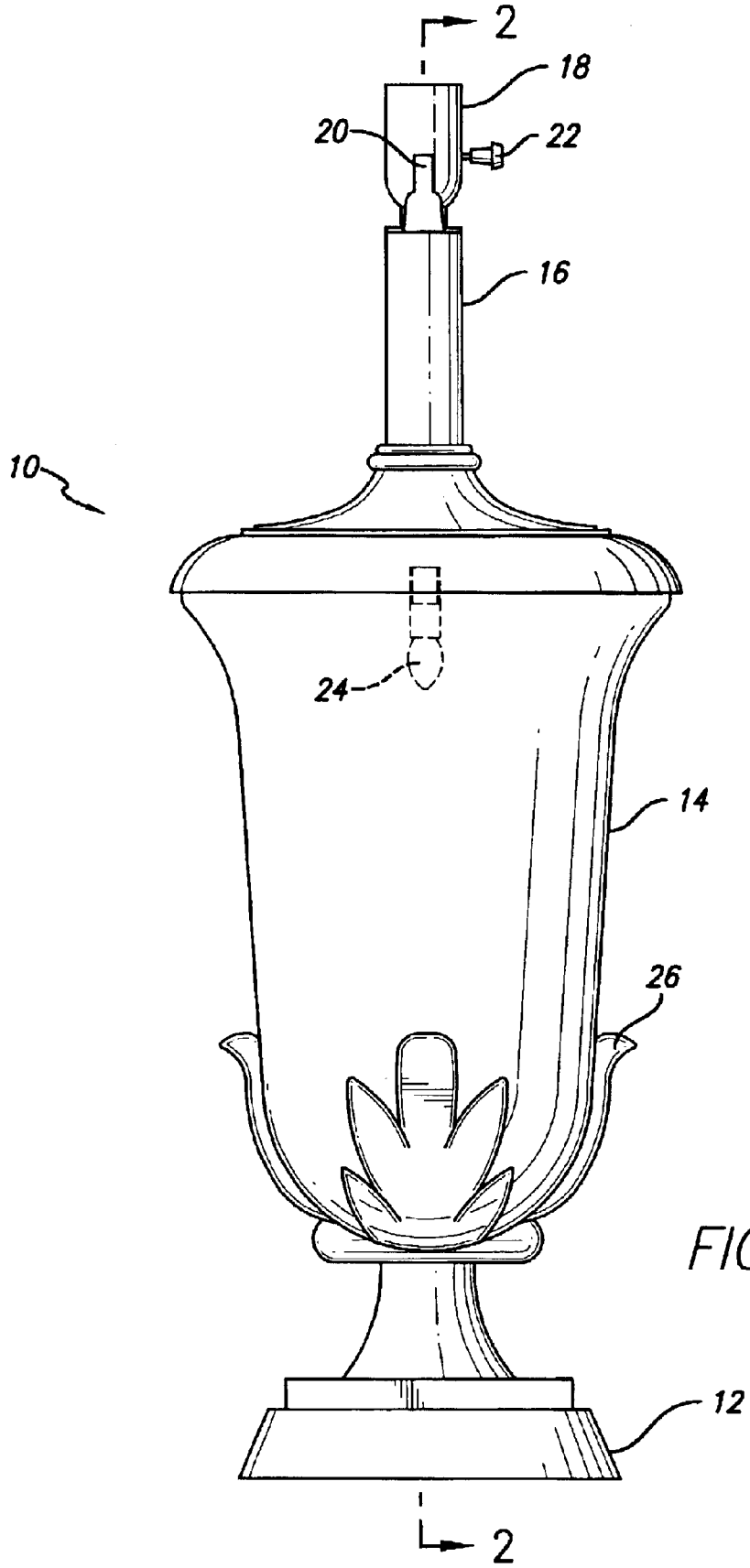
FIG. 1 is a plan view of a table or desk lamp constructed in accordance with the principles of the present invention.

One form of a lamp constructed in accordance with the principles of the present invention is illustrated in FIG. 1 to which reference is hereby made. As is therein shown a table lamp 10 includes a pedestal 12 which supports a body 14. Extending upwardly from the body 14 is a tubular member 16 which supports a light socket 18 for receiving a typical light bulb (not shown) for use as a general area lighting means. A multi-way switch 22 is provided to allow energization of the general area lighting means or the night light. A saddle 20 is affixed to the member 16 and receives the typical wire lampshade support (not shown). A low illumination light bulb (night light) 24 is disposed internally of the body 14 as indicated by the dashed lines. The body 14 is constructed of translucent material such as plastic, glass, fabric or the like depending upon the particular design criteria and decorative environment in which the lamp is to be utilized. In accordance with a preferred embodiment of the present invention the body 14 is constructed of translucent glass and is supported within a decorative fixture 26 carried by the pedestal 12. It should be expressly understood that the pedestal 12 may be eliminated and the stem of a floor lamp substituted for it with the pedestal then being the terminus of the floor lamp and upon which the floor lamp is supported during use.

Figure 2A:
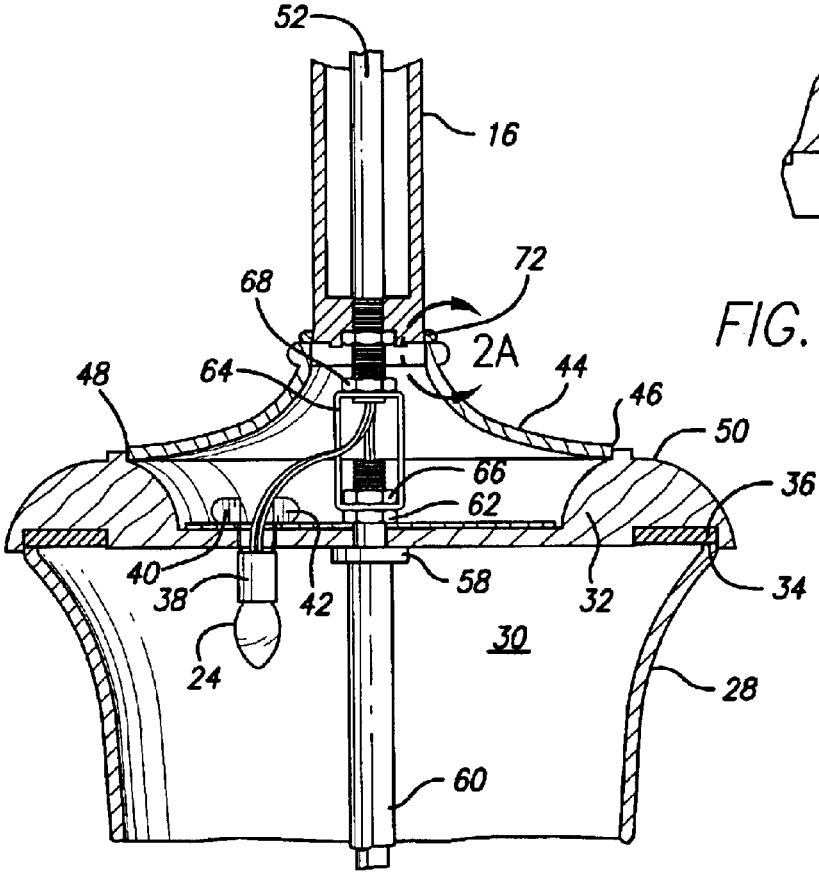
FIG. 2A is a fragmentary view showing the securing ring.
Figure 2A:
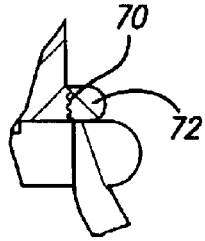
Figure 2:
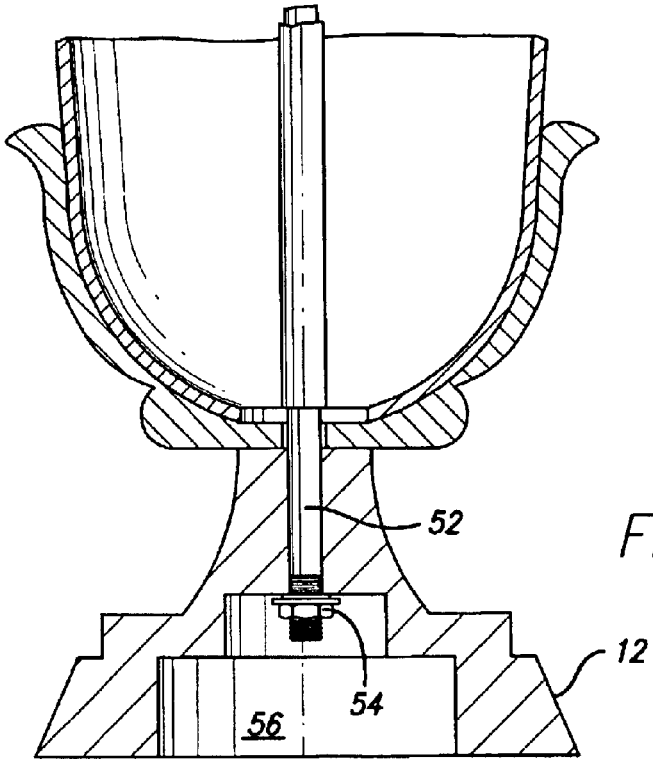
FIG. 2 is a partial cross-sectional view of the lamp illustrated in FIG. 1, taken about the lines 2—2 thereof.

The construction of the lamp constructed in accordance with the principles of the present invention is illustrated in more detail in FIG. 2. The body 14 includes an enclosure 28 defining a hollow chamber 30. The bulb 24 is disposed internally of the chamber 30. The chamber 30 is essentially closed at the top thereof by a member 32 which is supported upon the upper edge 34 of the enclosure 28. An appropriate gasket or similar elastomeric material 36 is contained about the periphery of the upper most part of the enclosure. The elastomeric material 36 cushions the contact between the upper portion 34 of the enclosure 28 and the member 32. The bulb 24 is contained within a typical light bulb socket 38 which has a pair of clips 40 and 42 affixed thereto. Preferably the enclosure 28 is constructed of material which is translucent in nature to allow a low light level to be emanated from the lamp 10 when the bulb 24 is illuminated. Alternatively the enclosure 28 may be constructed of material which is partially opaque and partially translucent to provide desired decorative affects depending upon the environment in which the lamp 10 is to be used. A top plate or cap 44 includes a periphery 46 which is seated on a ledge or within a groove 48 formed upon the upper surface 50 of the member 32.

Disposed within the chamber and extending between the pedestal 12 and the socket 18 is a hollow conduit 52 which receives electrical wires. The conduit is held in place by an appropriate washer and nut combination 54 disposed within a cavity 56 defined by the pedestal 12 at the opposite end of the chamber 30 there is provided a washer or spacer member 58 which is supported on top of a sleeve 60 surrounding the conduit 52. The conduit extends through a central orifice in the member 32 and is secured in place by an appropriate nut 62 which also functions to hold the member 32 in place on top of the enclosure 28. As illustrated, the conduit 52 is separated into two portions with the upper portion extending through the extension 16 and being supported upon a bracket 64 which is held in place with an additional nut 66 thus securing the bracket in its lower most portion between the nuts 62 and 66. An additional nut 68 secures a lower end of the upper section of the conduit 52 to the top of the bracket 64. As is illustrated, the extension 16 is also threaded onto the lower threaded portion of the conduit 52.

The lower outer periphery of the extension 16 is threaded as shown at 70 in FIG. 2A. The threads 70 receive a solid ring 72 which is used to lock the top plate or cap 44 in place for normal use of the lamp 10. This ring, however, may be turned preferably in a counter-clockwise rotational direction to release it from the threads 70, thus allowing the solid ring 72 to move upwardly over the outer surface of the extension 16. When such occurs, the top plate or cap 44 may then be moved upwardly by grasping the upper portion thereof. When such occurs, the top plate or can 44 is moved away from the upper member 32 of the enclosure, thus allowing access to the clips 40 and 42.

Figure 3:
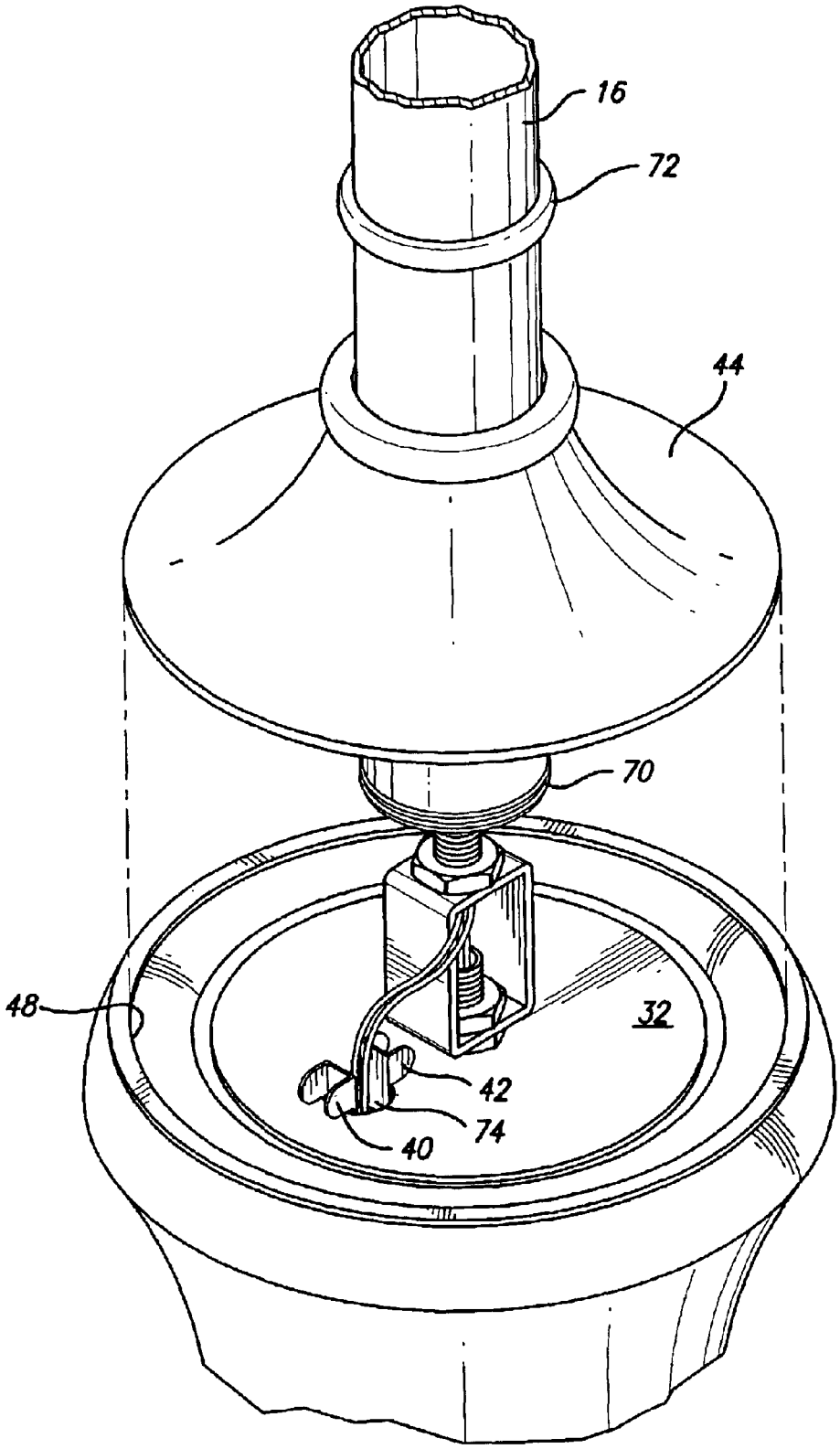
FIG. 3 is a partial perspective view of the lamp of FIG. 1 with the upper portion removed therefrom.

This operation is better illustrated in FIG. 3, to which reference is hereby made. As is therein illustrated, the solid ring 72 has been unscrewed from the threads 70 on the bottom portion of the extension 16. The top plate or cap 44 has then been moved upwardly from its seat 48 thus exposing the clips 40 and 42. By compressing the clips 40 and 42 inwardly, the bulb 24 and its socket 38 may be removed through the opening 74 provided in the member 32, which bridges the upper surface of the enclosure 28 to define the chamber 30.

Figure 4:
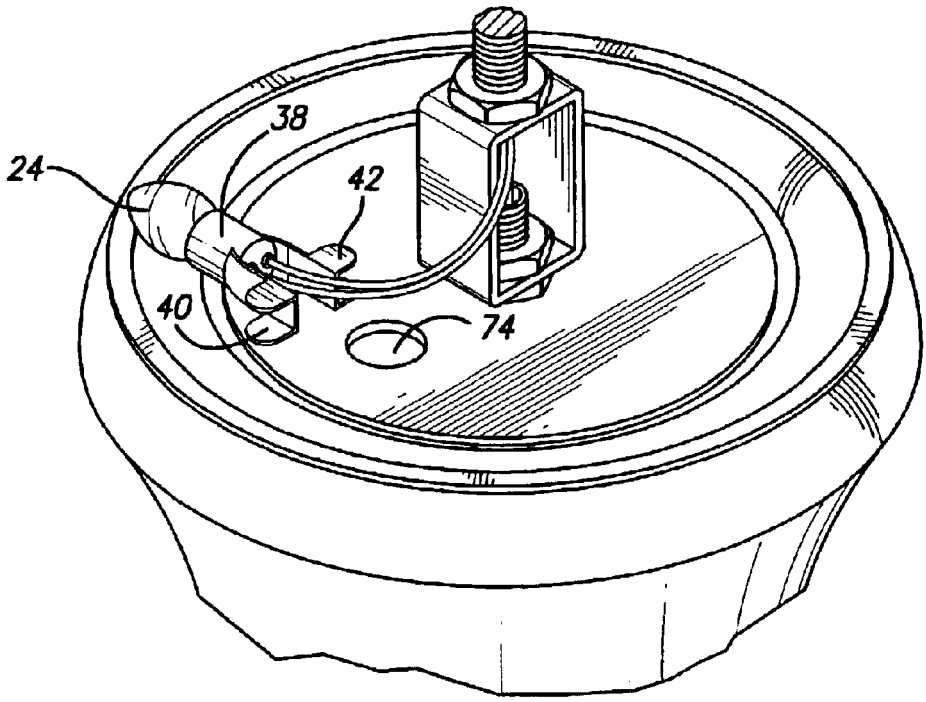
FIG. 4 is a partial view of the lamp shown in FIG. 2, illustrating removal of the low light level light bulb from the structure.
Figure 5:
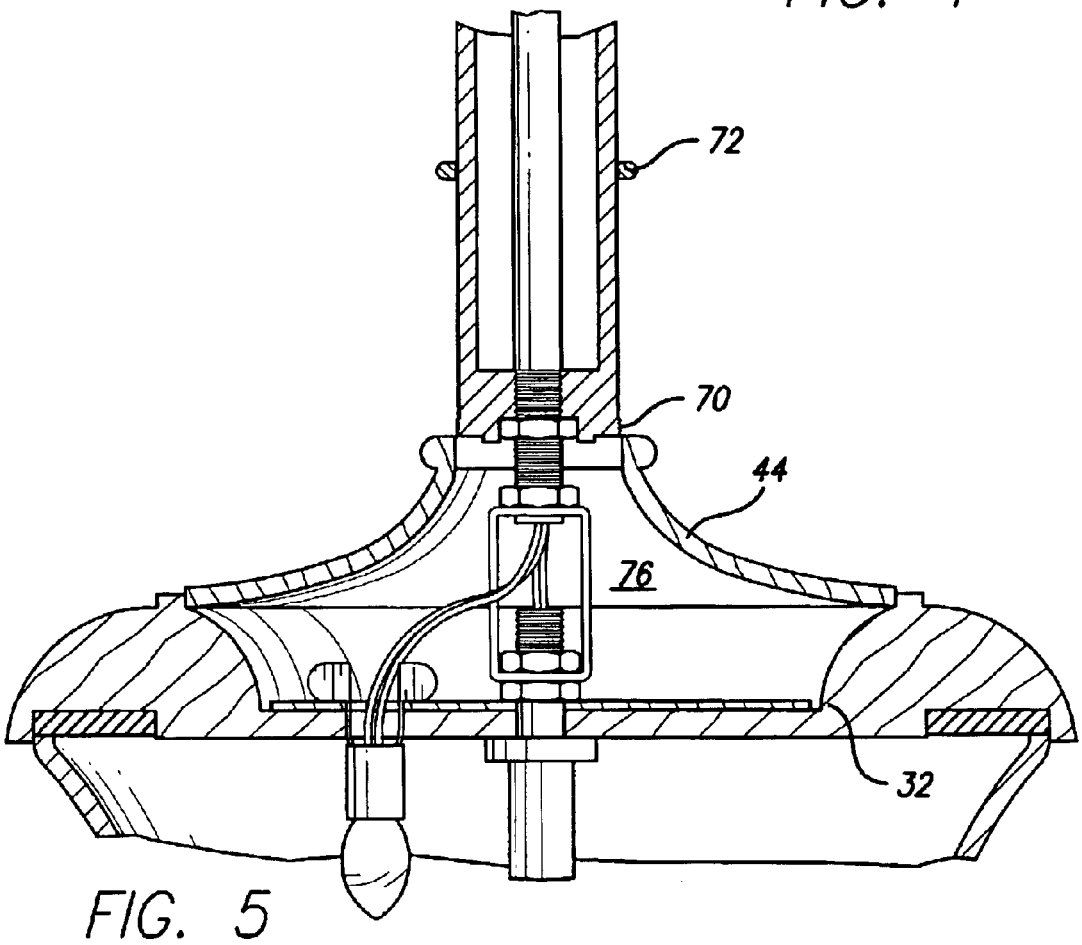
FIG. 5 is a partial cross-sectional view of the upper portion of the lamp housing the low light level bulb.

As is clearly shown in FIG. 4, the light socket 38 is formed with the clips 40 and 42 secured thereto. The clips are formed from spring metal so that when pressure is released the clips 40 and 42 will move outwardly, that is, away from the central axis of the light socket 38 in such a way that they will engage the periphery of the opening 74 defined by the upper member 32. By so doing, the bulb 24 is secured in place internally of the chamber 32 to function as a traditional night light. As is clearly shown in FIG. 5, the combination of the member 32 and the top plate or cap 44 provides an adequate cavity 76 for receiving the night light socket and clips without interference from the structure defining the chamber and the top plate. As is clearly illustrated in FIG. 4, when the clips 40 and 42 are pressed together, the socket 38 and its bulb 24 may easily be removed from the chamber 30 by extracting it through the opening 74 defined by the member 32. The bulb 24 may then be changed as desired and by reversing the procedure, that is, inserting the bulb 24 and the socket 38 through the orifice 74 and allowing the clips 40 and 42 to naturally extend outwardly, the bulb is then replaced within the chamber 30 for its normal functioning as a night light or decoration.

Figure 6:
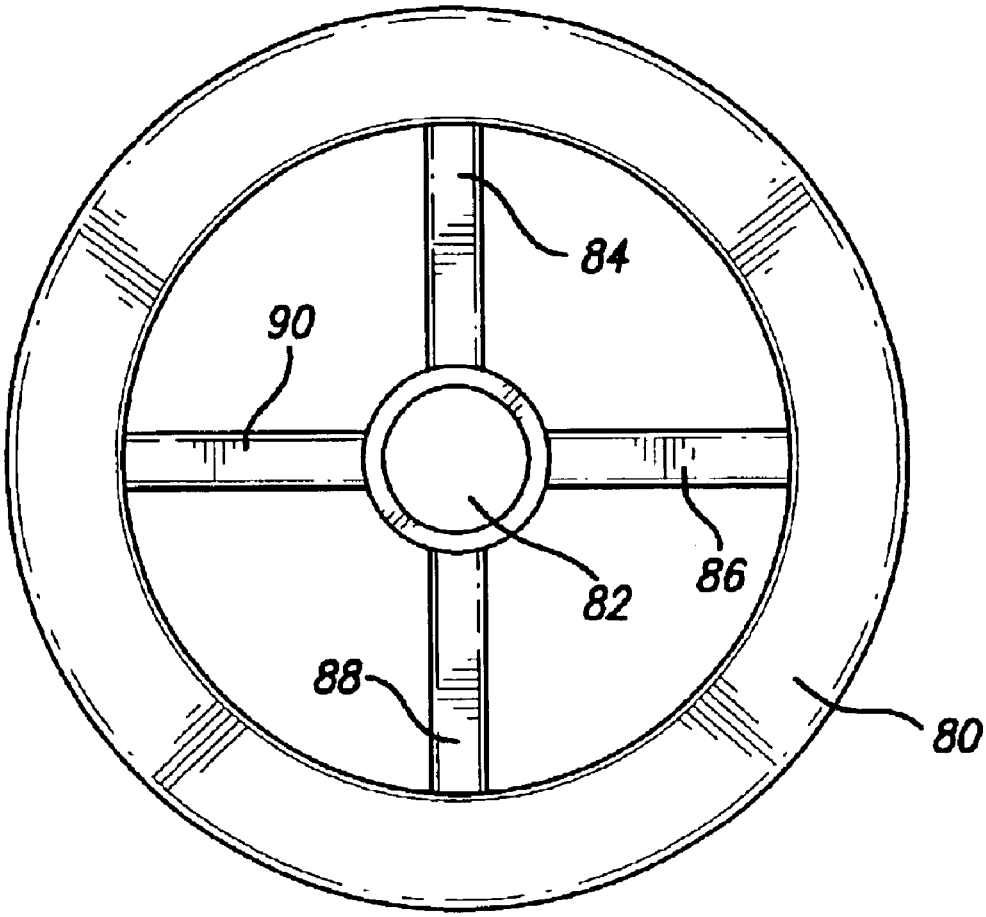
FIG. 6 is a plan view of an alternative embodiment of a member for supporting the low light level light bulb.

Although the upper member 32 which provides a means for supporting the lamp 24 is illustrated as a solid disk defining an orifice for receiving the bulb, it should be understood that any number of additional configurations of such a supporting means for the lamp may be utilized. One alternative member is shown in FIG. 6, to which reference is hereby made. As is therein indicated, there is provided a ring 80 having a center section 82 with a plurality of spokes or arms 84, 86, 88 and 90 interconnecting the center section 82 and the rim 80. The structure as shown in FIG. 6 may be substituted for the central disk-like portion of the member 32 by providing a ledge or seat within which it can be received. The lamp socket 38 may then be provided with a hook-type structure which could be placed over one of the arms 84 through 90 to allow the bulb 24 to extend into the chamber 30. It would be obvious to those skilled in the art that through the utilization of a structure such as shown in FIG. 6, when the top plate or can 44 is removed as above described, one may simply reach in and unhook the light socket and burned-out bulb and replace the burned-out bulb as desired.

What is claimed is:

1. A lamp having a low light level bulb housed within a hollow chamber and structured to permit easy replacement of the low light level bulb comprising:

(a) a hollow body having an upper edge, at least a portion of said body being formed of a translucent material;

(b) a member disposed over and engaging said upper edge to close said body and define a hollow chamber, said member defining an orifice therethrough;

(c) a low light level light bulb extending through said orifice and into said hollow chamber;

(d) a removable cap disposed over said member;

(e) a tubular member extending upwardly from said cap for carrying a light socket for receiving a general area light bulb, said tubular member defining threads at an end thereof adjacent and extending above said cap; and (f) a ring surrounding said tubular member and adapted to be threadably received on said threads to secure said cap in place or removed from said threads to allow said cap to be moved upwardly along said tubular member.

2. A lamp as defined in claim 1 wherein said member engaging said upper edge further includes an elastomeric material, engaging said upper edge of said hollow body.

3. A lamp having a low light level bulb housed within a hollow chamber comprising:

(a) an enclosure defining said hollow chamber;

(b) means for supporting said bulb within said chamber including (1) a disk disposed adjacent an uppermost part of said enclosure and bridging said enclosure;

(2) said disk defining an orifice therein for receiving said bulb; and (3) a resiliently deformable clip engaging said disk at said orifice to support said bulb within said chamber;

(c) at least a portion of said enclosure being formed of translucent material; and (d) means in said enclosure for providing access to said bulb to change said bulb.

4. A lamp as defined in claim 3 which further includes a socket for receiving said bulb and said clip carried by said socket.

5. A lamp having a low light level bulb housed within a hollow chamber comprising:

(a) an enclosure defining said hollow chamber;

(b) means for supporting said bulb within said chamber including a ring having a plurality of spokes extending between a center section and rim thereof;

(c) at least a portion of said enclosure being formed of translucent material; and (d) means in said enclosure for providing access to said bulb to change said bulb.

6. A lamp as defined in claim 5 wherein said means for providing access is a removable cap extending over said ring.

7. A lamp as defined in claim 6 wherein said removable cap is disposed at said uppermost part of said enclosure.

8. A lamp having a low light level bulb housed within a hollow chamber comprising:

(a) means defining an enclosed hollow chamber and having an upper end;

(b) a low light level bulb;

(c) means extending said upper of said chamber for supporting said low light level bulb within said chamber;

(d) at least a portion of said enclosure being formed of translucent material;

(e) a removable cap having a central opening therein disposed over the upper end of said enclosed hollow chamber;

(f) a tubular member extending through said opening in said cap, said tubular member defining external threads adjacent and above said cap; and (g) a threaded ring threadably received on said threads on said tubular member to secure said cap in place, whereby when said ring is threadably removed from said threads, said cap may be moved away from said upper end of said enclosed hollow chamber for allowing easy access to said low light level bulb.

9. A lamp as defined in claim 8 wherein said member is a disk.

10. A lamp as defined in claim 9 wherein said disk defines an orifice therein for receiving said bulb.

11. A lamp as defined in claim 10 which further includes a resiliently deformable clip engaging said disk at said orifice to support said bulb within said chamber.

12. A lamp as defined in claim 11 which further includes a socket for receiving said bulb and said clip is carried by said socket.

13. A lamp as defined in claim 8 wherein said member includes a plurality of arms.

* * * * *